US005605229A

United States Patent [19]

Sowa

[11] Patent Number: 5,605,229

[45] Date of Patent: Feb. 25, 1997

[54] BULK VERTICAL WINDOW PACKAGE

[75] Inventor: Paul E. Sowa, Wheeling, Ill.

[73] Assignee: Illinois Tool Works Inc., Glenview, Ill.

[21] Appl. No.: 394,788

[22] Filed: Feb. 27, 1995

[51] Int. Cl.[6] ..... B65D 85/48

[52] U.S. Cl. ..... 206/454; 206/453; 206/325; 206/586; 206/587; 206/776; 206/783

[58] Field of Search ..... 206/448, 454, 206/453, 325, 585, 586, 321, 386, 485, 497, 587, 593, 594, 45.31, 600, 597

[56] References Cited

U.S. PATENT DOCUMENTS

| | | | |
|---|---|---|---|
| T927,008 | 10/1974 | Sherman et al. | 206/449 X |
| 2,164,506 | 7/1939 | Enrich | 206/45.31 |
| 2,194,669 | 3/1940 | Mumford | 206/454 X |
| 2,611,527 | 9/1952 | Fisher | 206/45.31 |
| 2,746,667 | 5/1956 | Murphy | 206/454 X |
| 2,807,360 | 9/1957 | Nurre | 206/448 |
| 2,939,620 | 6/1960 | Royce | 206/45.31 |
| 2,957,575 | 10/1960 | Grim et al. | 206/448 |
| 2,967,009 | 1/1961 | Lidgard | 206/448 |
| 3,043,488 | 7/1962 | Loarwick | 206/448 |
| 3,050,234 | 8/1962 | Salmon | 229/51 |
| 3,133,687 | 5/1964 | Fremion | 206/448 X |
| 3,379,359 | 4/1968 | Arneson | 206/45.31 |
| 3,438,488 | 4/1969 | Rohde | 206/62 |
| 3,990,576 | 11/1976 | Heaney | 206/453 |
| 4,030,600 | 6/1977 | Heaps | 206/586 X |
| 4,042,127 | 8/1977 | Brossia | 206/386 |
| 4,127,188 | 11/1978 | Heaney | 206/453 |
| 4,182,450 | 1/1980 | Kryger | 206/448 |
| 4,225,043 | 9/1980 | Lastik | 206/448 |
| 4,303,157 | 12/1981 | Edwards | 206/335 |
| 4,353,466 | 10/1982 | Pater | 206/453 |
| 4,418,820 | 12/1983 | Nagle et al. | 206/334 |
| 4,805,774 | 2/1989 | Salisbury | 206/454 |
| 4,883,179 | 11/1989 | Dionne | 206/523 |
| 4,915,247 | 4/1990 | Odenthal | 220/4 F |
| 5,071,009 | 12/1991 | Ridgeway | 206/586 |
| 5,101,976 | 4/1992 | Salisbury | 206/454 |
| 5,131,541 | 7/1992 | Liebel | 206/453 |
| 5,161,692 | 11/1992 | Knierim | 206/586 |
| 5,215,248 | 6/1993 | Moser | 206/600 X |
| 5,269,422 | 12/1993 | Chevrette | 206/448 |
| 5,339,957 | 8/1994 | Carstens | 206/886 |

*Primary Examiner*—Paul T. Sewell
*Assistant Examiner*—Tara Laster
*Attorney, Agent, or Firm*—Schwartz & Weinrieb

[57] ABSTRACT

A package for packaging a plurality of frangible items, such as windows, doors and the like, includes a plurality of separate items, which includes a plurality of slotted upper and lower pads, a top sheet, a bottom sheet and end caps which are assembled together to form a package around the items. The items are disposed within the package in a side-by-side, spaced configuration. The top and bottom sheets overlay the top and bottom edges of the items, respectively. The upper and lower pads are sandwiched between the top sheet and the top edges of the items and the bottom sheet and the bottom edges of the items, respectively. The end caps overlay the side edges of the items and a portion of the middle section of the items while remaining portions of the middle sections exposed to view. Stretchable plastic film is wrapped around the package. A slip sheet is placed underneath the package and includes pull tabs which extend outwardly beyond the outer margins of the package so that the tines or steel plate of a lift truck can be slid underneath the package while being pulled by a front-end-attachment gripper bar on the lift truck to lift and handle the package.

20 Claims, 2 Drawing Sheets

BULK VERTICAL WINDOW PACKAGE

FIELD OF THE INVENTION

This invention is generally directed to a package for handling or shipping windows, doors and the like in bulk.

BACKGROUND OF THE INVENTION

Several packages for shipping windows, doors and the like have been heretofore proposed. For example, U.S. Pat. No. 4,225,043 discloses a shipping container for securing sheets, such as automotive lites. In general, the container is an enclosed crate structure which includes a base supported on runners, opposed end walls, a back wall, a front wall, and a top wall, all of which enclose the sheets therein. Slotted logs formed of compressible polyurethane are spaced apart from each other and are mounted on the base and on the top wall. Each sheet has lower and upper edge portions which are mounted in a slot in the logs secured to the base and the top wall, respectively, to secure the sheet within the container. The runners provide clearance for a fork-lift truck to lift the container. While this type of container has performed acceptably, the container is costly to manufacture due to its enclosed crate structure. The container is also costly to ship and can be difficult to handle due to its bulk and weight.

U.S. Pat. No. 4,127,188 discloses a container for shipping or transporting frangible doors. The container includes longitudinal sheets of paperboard which have spacing elements thereon for holding and containing the doors therein. One sheet is placed under the container and another sheet is placed on top of the container. The sides of the sheet overlap each other and are affixed together. The sheets are folded upwardly to overlay the sides of the doors. The container has supports attached thereunder which elevate the container to provide clearance for a fork-lift truck to lift the container. A transparent plastic covering may be wrapped around the container. While this type of container has also performed acceptably, large amounts of material are wasted due to the overlapping structure of the sides of the sheets thus increasing the cost of the container.

The present invention presents a novel package for carrying windows, doors and the like in bulk during handling and/or transportation that overcomes or minimizes the problems presented hereinabove and also presents several advantages and improvements over the prior art.

OBJECTS OF THE INVENTION

A general object of the present invention is to provide a package for shipping or handling windows, doors and the like in bulk that can be economically shipped or transported.

Another general object of the present invention is to provide a package for shipping or handling windows, doors and the like in bulk that is easy and economical to manufacture.

An object of the present invention is to provide a package that is light-weight.

A further object of the present invention is to provide a package for transporting windows, doors and the like in bulk that is easy to assemble and disassemble.

Another object of the present invention is to provide a package that securely holds glass windows, doors and the like in bulk therein during transportation to minimize the possibility of breakage.

A specific object of the present invention is to provide a package formed of separate components which can be cost effectively shipped to a user who can assemble the package for use.

Another specific object of the present invention is to provide a package for transporting glass windows, doors and the like, that allows a shipper or handler to see the contents of the package so that the shipper or handler knows of the fragile nature of the enclosed contents.

SUMMARY OF THE INVENTION

Briefly, and in accordance with the foregoing, the present invention discloses a package for packaging a plurality of frangible items, such as glass windows, glass doors and the like. Each of the items includes a top edge, a bottom edge and a middle section therebetween which has opposed side edges. The items are disposed within the package side-by-side, in parallel relationship, to one another and spaced apart from each other. Thus, two items are on the end of the arrangement.

The package includes a plurality of separate components which are easily assembled together around the items to form the package. A top sheet or member overlays the top edges of the items, a bottom sheet or member underlies the bottom edges of the items; and end caps overlay the side edges of the items. The end caps also overlay portions of the top and bottom sheets and portions of the middle sections of the items on the end of the arrangement. The end caps overlay the middle sections of the items but leave portions of the middle sections exposed to view so that a handler can see the frangible nature of the items being transported or handled. The top and bottom sheets and the end caps are preferably formed from corrugated cardboard.

A plurality of pads are sandwiched between the top sheet and the top edges of the items. Each pad includes a plurality of slots, each of which engages a top edge of one of the items. The upper pads are spaced apart from each other with one pad disposed approximately at the midpoint of the top sheet and a pad near each of the margins of the top sheet. A plurality of pads are also sandwiched between the bottom sheet and the bottom edges of the items. Each of these lower pads includes a plurality of slots, each of which engages a bottom edge of one of the items. The lower pads are similarly spaced apart from each other with respect to the bottom sheet in a like manner to which the upper pads are spaced apart from each other with respect to the top sheet. The pads are preferably formed from sheets of corrugated cardboard having a hexagonal core therebetween, commonly known as Hexacomb®. Hexacomb® is a registered trademark of the Hexagon Honeycomb Corporation of St. Louis, Mo.

To assemble the package, the upper and lower pads are attached to the top and bottom edges of the items, respectively. The top and bottom sheets are placed in an abutting relationship with the upper and lower pads respectively. The top and bottom sheets can be affixed to the upper and lower pads, respectively, by suitable means, such as glue. The end caps are placed over the side edges of the package and overlap portions of the middle sections of the items on the end of the arrangement and portions of the top and bottom sheets. The end caps do not completely overlap the middle sections of the items so as to leave portions of the middle sections exposed to view so that a handler or a shipper can see the frangible nature of the goods.

After the package has been assembled, a suitable stretchable plastic film is wrapped around the package. The film creates a tight, resilient package and resists scratches and possible marring of the items therein from outside elements.

After the package has been wrapped with film, the package can be placed on top of a slip sheet. The slip sheet may be formed from solid fiberboard. The slip sheet includes tab portions which extend outwardly beyond the outer margins of the bottom sheet so that the tines or steel plate of a lift truck can be slid underneath the package while being pulled by a front-end-attachment gripper bar on the lift truck so that the package can be lifted and handled.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements throughout the several views and in which.

DETAILED DESCRIPTION OF THE PREFERRED EMBODIMENT

Figure 1:
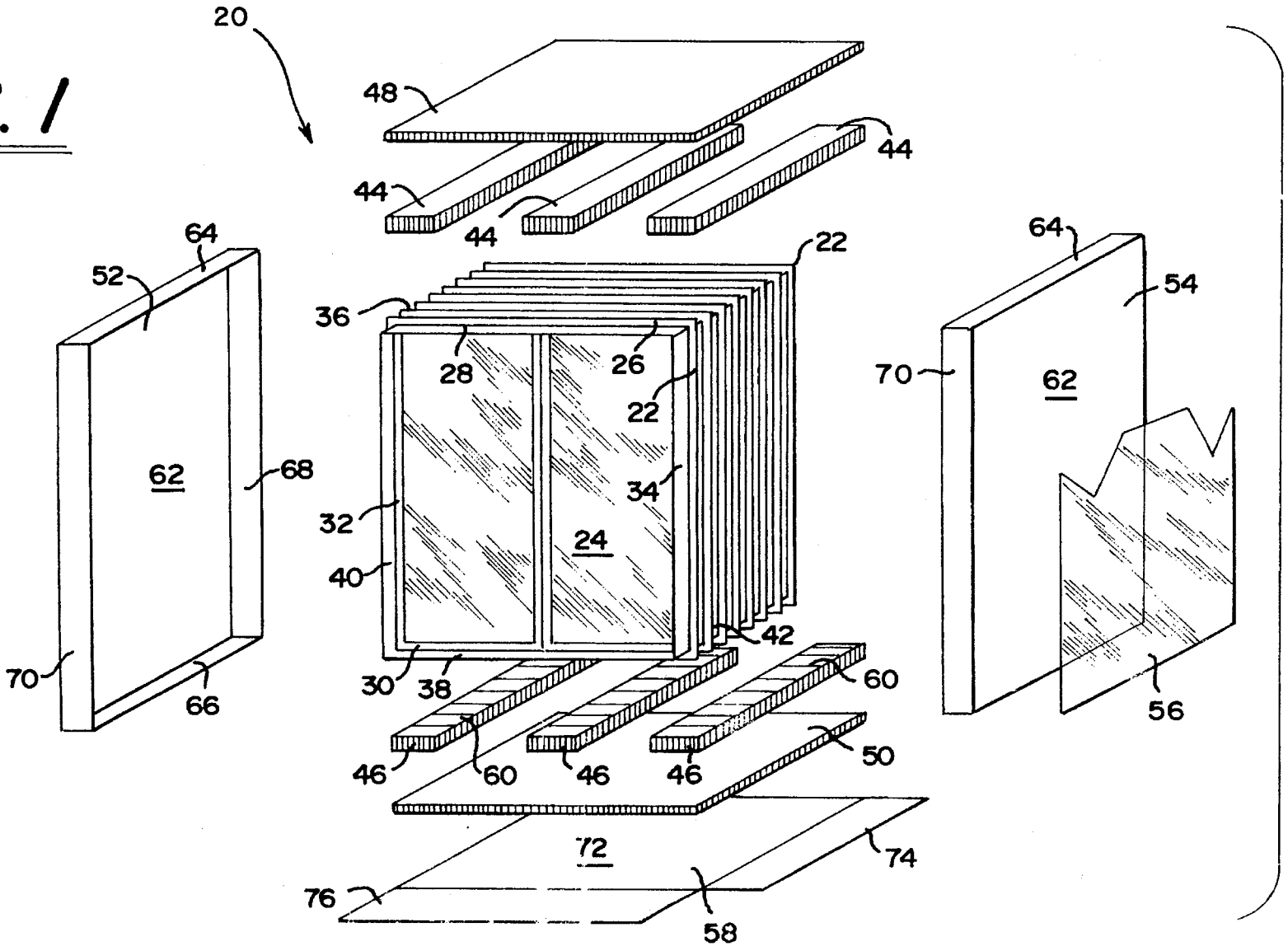
FIG. 1 is an exploded view of a package for shipping windows, doors and the like, which incorporates the features of the invention.
Figure 2:
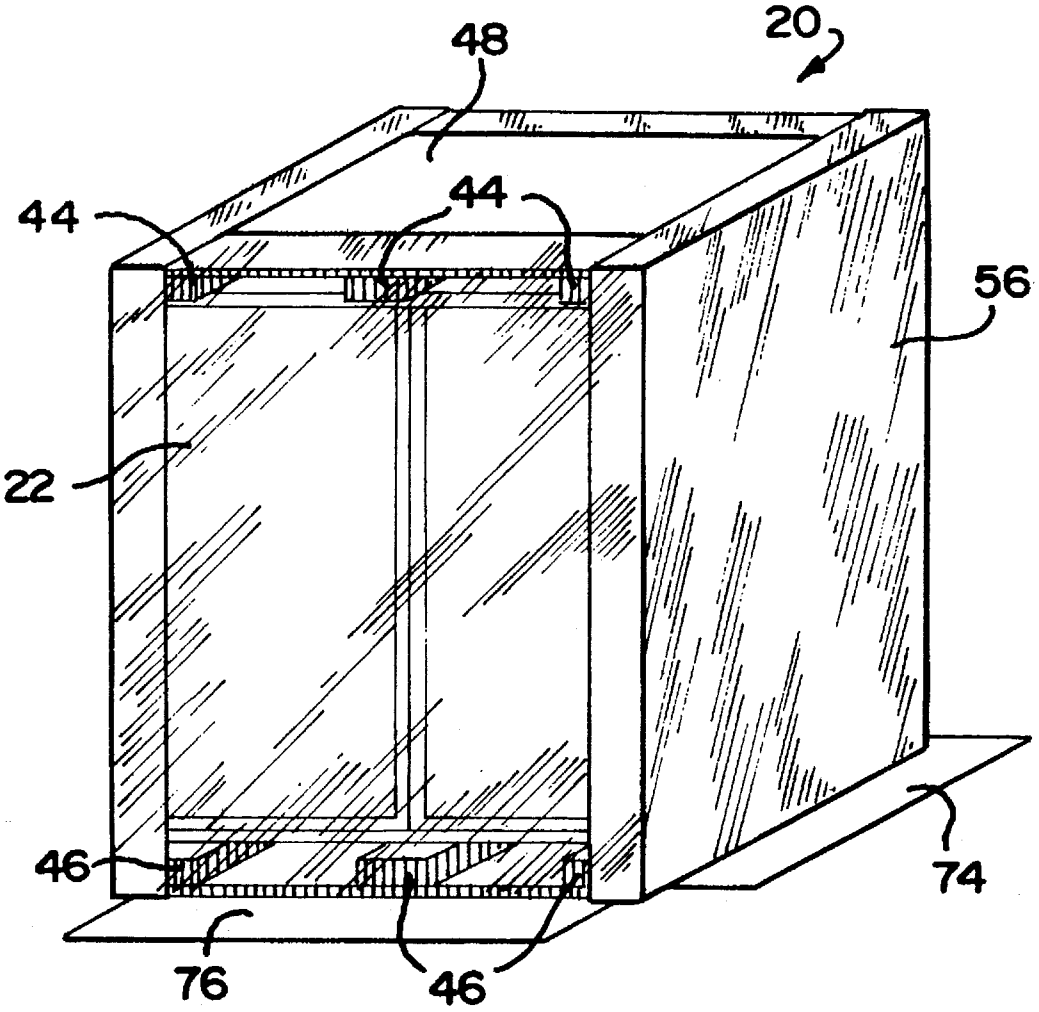
FIG. 2 is an assembled view of the package of FIG. 1.

While the invention may be susceptible to embodiment in different forms, there is shown in the drawings, and will herein be described in detail, a specific embodiment with the understanding that the present disclosure is to be considered an exemplification of the principles of the invention, and is not intended to limit the invention to that as illustrated and described herein.

The present invention discloses a package 20 for shipping or transporting frangible items 22, such as glass windows, doors and the like. While the package 20 of the present invention is disclosed herein as being used to ship or transport frangible items 22, it is to be understood that non-frangible items may be shipped within the package 20. For purposes of simplicity, the items 22 described herein are windows, such as storm windows.

Each window 22 has a glass middle section 24, such as a glass pane, surrounded by a mounting frame 26. The frame 26 has a top edge 28, a bottom edge 30 and opposing side edges 32, 34, each of which extends from the top edge 28 to the bottom edge 30 and joins the top edge 28 and the bottom edge 30 together at corners. Each edge 28, 30, 32, 34 has a mounting flange 36, 38, 40, 42, respectively, thereon for reasons to be described hereinbelow. The frame 26 is made of a suitable material, such as metal, wood and the like.

The package 20 is formed of a plurality of separate components which are separately manufactured. The package 20 includes an upper set of pads 44, a lower set of pads 46, a top sheet or member 48, a bottom sheet or member 50 and end caps 52, 54. When the components are assembled around the windows 22, a stretchable, plastic film 56, as will be described in detail hereinbelow, is wrapped around the components to form the completed package 20. The package 20 can be set upon a conventional slip sheet 58 for reasons to be described hereinbelow. The windows 22 are seated within the package 20 in a side-by-side configuration with the windows 22 being parallel to and spaced apart from one another. Thus, a window is seated on each end of the package 20 and additional windows are seated between the end windows.

The upper set of pads 44 are sandwiched between the top sheet 48 and the top edges 28 of the windows. The upper set of pads 44 are spaced apart from each other with a first pad generally at the midpoint of the top sheet 48, a second pad near one margin of the top sheet 48 and a third pad near the opposite margin of the top sheet 48.

The lower set of pads 46 are sandwiched between the bottom sheet 50 and the bottom edges 30 of the windows 22. The lower set of pads 46 are arranged with respect to the bottom sheet 50 in a manner similar to the arrangement of the upper pads 44 with respect to the top sheet 48. The lower set of pads 46 are spaced apart from each other with a first pad generally at the midpoint of the bottom sheet 50, a second pad near one margin of the bottom sheet 50 and a third pad near the opposite margin of the bottom sheet 50.

The pads 44, 46 are formed from a suitable lightweight, substantially rigid material. Preferably, each pad 44, 46 is formed from conventional materials, such as two sheets of corrugated paperboard with a core therebetween. Preferably, the core is formed from a Hexacomb® core which includes a plurality of connected hexagonal-shaped cells. Hexacomb® is a registered trademark of the Hexagon Honeycomb Corporation of St. Louis, Mo.

Each pad 44, 46 includes a plurality of spaced slots or slits 60 along the length of the pad 44, 46 which slits 60 are of a predetermined width and extend a predetermined distance into the pad 44, 46, but not completely through the pad 44, 46. Each slit 60 is adapted to receive and retain the edges of the windows 22. Each slit 60 in each upper pad 44 securely holds the mounting flange 36 on the top edge 28 of each window 22 therein. Each slit 60 in each lower pad 46 securely holds the mounting flange 38 on the bottom edge 30 of each window 22 therein. The widths of the windows 22 are disposed perpendicular to the lengths of the pads 22, 24. When the windows 22 are seated in the package 20, the windows 22 are spaced apart relative to one another and do not contact one another.

The slits 60 preferably have a width which is substantially the same as the width of the mounting flange 36, 38 on the top and bottom edges 28, 30 of the window 22. The distance in which the slits 60 extend into each pad 44, 46 is preferably substantially the same as the depth of the mounting flange 36, 38. With these dimensions, each mounting flange 36, 38 is firmly and securely held within a slit 60 in each pad 44, 46 so that the windows 22 cannot shift relative to the pads 44, 46. As shown, each pad 44, 46 has eight slits therein to correspond to the number of windows being transported within the package 20, however, more or less slits may be provided in the pads to correspond to the number of windows to be transported.

The upper surfaces of the upper pads 44, that is, the surface that does not have slits 60 therein, may be attached to the underside of the top sheet 48 and the lower surfaces of the lower pads 46, that is, the surface that does not have slits 60 therein, may be attached to the topside of the bottom sheet 50 by conventional means, such as adhesive. When the pads 44, 46 are secured to the sheets 48, 50, respectively, the pads 44, 46 and thus the windows 20, are prevented from shifting relative to the sheets 48, 50.

The top and bottom sheets 48, 50 are flat members and are made of suitable, substantially rigid or stiff, lightweight materials, such as corrugated cardboard or paperboard. The windows 22 are positioned perpendicular to the sheets 48, 50 so that the windows 22 stand vertically upward in the package 20. The corrugated cardboard provides rigidity to the package structure to prevent the package 20 from collapsing while being lightweight.

Since the pads 44, 46 and the sheets 48, 50 are made of substantially rigid materials, the windows 22 maintain the spacing therebetween and the possibility of the windows 22 shifting relative to the pads 44, 46 and the sheets 48, 50 is minimized. Thus, the possibility of the windows 22 contacting each other, and thus possible breakage, is minimized. The upper set of pads 44 and the top sheet 48, and the lower set of pads 46 and the bottom sheet 50 also serve to protect the top and bottom edges 28, 30 of the windows 22, respectively, to minimize the possibility of damage to the windows 22.

The end caps 52, 54 are placed over the sides of the windows 22. The end caps 52, 54 are made of suitable, lightweight, substantially rigid or stiff materials, such as corrugated cardboard or paperboard. Each end cap 52, 54 has a base portion or wall 62, a top portion or relatively short flange 64 which extends from one side of the base wall 62 and is perpendicular to the base wall 62, a short bottom portion or relatively short flange 66 which extends from the opposite side of the base wall 62 and is perpendicular to the base wall 62, and short side portions or relatively short flanges 68, 70 which extend from the remaining sides of the base wall 62 and are perpendicular to the base wall 62. The side flanges 68, 70 of the end caps 52, 54 extend between the top and bottom flanges 64, 66 and join the top and bottom flanges 64, 66 at corners.

The base wall 62 of each end cap 52, 54 overlies the side edges 40, 42, respectively, of the windows 22. The top relatively short flange 64 of each end cap 52, 54 overlies a portion of the top sheet 48 and the bottom relatively short flange 66 of each end cap 52, 54 underlies a portion of the bottom sheet 50 such that each top and bottom flange 64, 66 of each end cap 52, 54 embraces and retains the top and bottom sheets 48, 50, respectively, within the package 20. Thus, the inner surface of the top and bottom flanges 64, 66 of each end cap 52, 54 abuts against and engages the upper and lower surfaces of the top and bottom sheets 48, 50, respectively. The relatively short side flanges 68, 70 of each end cap 52, 54 overlay a portion of the middle section 24 of the windows 22. The windows 22 seated on the end of the arrangement are spaced inwardly from the end of the pads 44, 46 and thus, the side flanges 68, 70 of the end caps 52, 54 do not contact the middle section 24 of the windows 22.

The relatively short top, bottom and side flanges 64, 66, 68, 70 of the end caps 52, 54 do not completely overlay the middle sections 24 of the windows 22 and thus, a substantial portion of the glass surfaces of the windows 22 are uncovered by the surrounding items and are exposed to view. Therefore, when a shipper or handler handles the package 20, the shipper or handler will be able to see that windows 22 are being transported and will know of the frangible nature of the goods being shipped. The end caps 52, 54 also serve to protect the side edges 40, 42 and the corners of the windows 22 to minimize the possibility of damage to the windows 22.

Once the end caps 52, 54 are in place, the unit is wrapped, preferably with the stretch film 56. The film 56 is preferably polyethylene, or like clear plastic that has a tackifier on one side, internal to the package, and fits tightly over the assembled components. The film 56 is wrapped around the components so that the film 56 covers the end caps 52, 54, the exposed middle section of the windows 22, and overlaps onto the top and bottom of the assembled components. On the top of the package 20, the film 56 overlaps the top flanges 64 of the end caps 52, 54 and portions of the top sheet 48. On the bottom of the package 20, the film 56 overlaps the bottom flanges 66 of the end caps 52, 54 and portions of the bottom sheet 50. The film 56 does not contact the middle sections 24 of the windows 22 on the ends of the arrangement. The wrapping is done quickly and easily to encircle and bind the set of windows 22, in fixed, parallel, spaced alignment within the package 20. Thereafter, the film 56 is stretch wrapped around the components by known methods. Preferably, the film 56 is applied in a spiral wrap using the SpiralGrip Low Profile Turntable stretch wrap system manufactured by Signode®. This creates a relatively-tight, strong, resilient, transparent sheeting over the glass-exposed faces of the package 20 to protect the glass surfaces against scratching or marring by outside objects. The transparent film 56 also minimizes the amount of dirt or moisture which can enter into the package 20. Alternatively, the package 20 may be completely enclosed in film.

After the package 20 has been wrapped in film 56, the package 20 is placed on a conventional caliper slip sheet 58 so that the package 20 can be easily moved. Along the sides of the package 20, one portion of each end cap 52 and 54 is sandwiched between the bottom sheet 50 and the slip sheet 58. In the middle of the package 20, the slip sheet 58 generally abuts against the bottom surface of the bottom sheet 50. The slip sheet 58 is formed from suitable, rigid, strong materials, such as solid fiberboard, and may be affixed to the bottom surface of the bottom sheet 50 by suitable means, such as adhesive or by being laminated to the bottom surface of the bottom sheet 50, to ensure that the slip sheet 58 and the package 20 cannot move relative to each other. The slip sheet 58 is used in place of a conventional pallet.

The slip sheet 58 is generally flat and has a base portion 72 and two pull tabs 74, 76 which extend outwardly from two adjacent sides of the base portion 72. The pull tabs 74, 76 extend outwardly from beneath the package 20. The base portion 72 of the slip sheet 58 has a width which is shorter than the width of the package 20 so that the slip sheet 58 does not sit beneath the end cap 52. In this configuration, if the slip sheet 58 is glued to the bottom surface of the bottom sheet 50, the slip sheet 58 is also not glued to the bottom of the end cap 54. Alternatively, the base portion 72 of the slip sheet 58 can be the same length and width as that of the package.

Since the slip sheet 58 is not glued to the end caps 52 and 54, a buyer can easily disassemble the package 20 to access the contents of the package 20. To disassemble the package 20, the film 56 is opened by suitable means. The end caps 52, 54 are slid off of the sides of the package 20. Since the end caps 52, 54 are not affixed to the slip sheet 58, the end caps 52, 54 are removed from the package 20 easily. Next, the top sheet 48 and the upper set of pads 44 are removed. Thereafter, the windows 22 can be easily removed from the bottom pads 46 and bottom sheet 50.

Each pull tab 74, 76 can flip up along a fold line which aligns with the edge of the package 20. When the pull tab 74 or 76 is flipped up, the tines or flat plate of a lift truck can get underneath the package 20. A gripper bar of a lift truck front-end-attachment clamps the pull tab 74 or 76 and retracts, thereby pulling the package 20 onto its tines or flat plate for lifting and handling. Thus, the window package 20 does not need to be put into a crate since the end caps 52, 54 function for the same purpose. It is within the scope of the invention that the package 20 could sit on a conventional pallet instead of the slip sheet 58 disclosed herein.

The package of the present invention presents several other advantages. The package 20 can be easily assembled and disassembled since the separate components of the package 20 are easy to handle. Since the package is lightweight, the cost of shipping or transporting the package is minimized. Furthermore, the components are easily and cost effectively manufactured from relatively inexpensive components. For example, each pad 44, 46 can be cut from sheets of paperboard having a Hexacomb® core therebetween to form the individual pads. Since the components are formed separately, to ship the components to a user, the components can be stacked on each other and shipped to a user who will later assemble the components into a package 20. For example, multiple top and bottom sheets 48, 50 can be stacked on top of each other during shipment and end caps 52, 54 can be stacked on each other during shipment to a user.

While a preferred embodiment of the present invention is shown and described, it is envisioned that those skilled in the art may devise various modifications of the present invention without departing from the spirit and scope of the invention as set forth in the appended claims.

The invention claimed is:

1. A package, comprising:

a plurality of items, wherein each one of said plurality of items includes a top edge portion, a bottom edge portion, and a middle section disposed between said top and bottom edge portions and having opposed side edge portions, and wherein said plurality of items are disposed within said package in a side-by-side manner and spaced apart from each other;

a top member overlying said top edge portions of said plurality of items and having opposed side edge portions respectively disposed adjacent to said opposed side edge portions of said plurality of items and disposed upon opposite sides of a middle portion of said top member;

a bottom member underlying said bottom edge portions of said plurality of items and having opposed side edge portions, disposed upon opposite sides of a middle portion of said bottom member, respectively disposed adjacent to said opposed side edge portions of said plurality of items;

means provided upon said top and bottom members for maintaining said plurality of items in spaced relationship with respect to each other; and first and second end caps respectively overlying said opposed side edge portions of each one of said plurality of items, and overlying said opposed side edge portions of both of said top and bottom members by being removably mounted upon said opposed side edge portions of said top and bottom members so as to embrace and retain said top and bottom members in position with respect to each other, and with respect to said side edge portions of each one of said plurality of items, and yet facilitate disassembly of said package by removal of said first and second end caps from said opposed side edge portions of said top and bottom members, when said plurality of items are to be removed from said package, with said opposed side edge portions of said top and bottom members remaining intact with said middle portions of said top and bottom members so as to permit reassembly of said first and second end caps onto said opposed side edge portions of said top and bottom members when reassembly of said package is desired, said first and second end caps also overlying said opposed side edge portions of said plurality of items in such a manner as to leave a portion of said middle section of at least one of said plurality of items, disposed upon one end of said package, exposed to view.

2. A package as defined in claim 1, further including film wrapped around said package.

3. The package as set forth in claim 1, wherein:

said top member, said bottom member, and said first and second end caps comprise corrugated cardboard.

4. The package as set forth in claim 1, wherein:

said plurality of items comprises windows.

5. The package as set forth in claim 1, wherein:

said plurality of items comprises doors.

6. The package as set forth in claim 1, wherein:

said plurality of items are planar items disposed within planes which are oriented substantially perpendicular to planes within which said top and bottom members are disposed.

7. The package as set forth in claim 2, wherein:

said film comprises polyethylene.

8. A package, comprising:

a plurality of items, wherein each one of said plurality of items includes a top edge portion, a bottom edge portion, and a middle section disposed between said top and bottom edge portions and having opposed side edge portions, and wherein said plurality of items are disposed within said package in a side-by-side manner and spaced apart from each other;

a top sheet overlying said top edge portions of said plurality of items and having opposed side edge portions respectively disposed adjacent to said opposed side edge portions of said plurality of items and disposed upon opposite sides of a middle portion of said top sheet;

a bottom sheet underlying said bottom edge portions of said plurality of items and having opposed side edge portions, disposed upon opposite sides of a middle portion of said bottom sheet, respectively disposed adjacent to said opposed side edge portions of said plurality of items;

means provided upon said top and bottom sheets for maintaining said plurality of items in spaced relationship with respect to each other;

end caps respectively overlying said opposed side edge portions of said plurality of items, overlying said opposed side edge portions of both of said top and bottom sheets by being removably mounted upon said opposed side edge portions of said top and bottom sheets so as to embrace and retain said top and bottom sheets in position with respect to each other, and with respect to said opposed side edge portions of said plurality of items, and yet facilitate disassembly of said package by removal of said end caps from said opposed side edge portions of said top and bottom sheets, when said plurality of items are to be removed from said package, with said opposed side edge portions of said top and bottom sheets remaining intact with said middle portions of said top and bottom sheets so as to permit reassembly of said end caps onto said opposed side edge portions of said top and bottom sheets when reassembly of said package is desired, and further overlying portions of said middle section of at least one of said plurality of items, disposed upon one end of said package, such that remaining portions of said middle section of said at least one of said plurality of items, not covered by said end caps, are exposed to view; and film wrapped around said end caps and said exposed middle section portions of said at least one of said plurality of items, disposed upon said one end of said package, when said package is assembled.

9. A package as defined in claim 8, wherein said top and bottom sheets and said end caps are formed from corrugated cardboard.

10. A package as defined in claim 8, wherein said top and bottom sheets have an upper surface and a lower surface; and said package further includes at least one upper pad having a plurality of spaced slits therein, said upper pad abutting against the lower surface of said top sheet, each of said top edge portions of said items being engaged within a slit in said upper pad; and a lower pad having a plurality of spaced slits therein, said lower pad abutting against the upper surface of said bottom sheet, each of said bottom edge portions of said items being engaged within a slit in said lower pad.

11. A package as defined in claim 10, wherein said package includes at least two upper and lower pads.

12. A package as defined in claim 11, wherein:

said upper pads are spaced apart from each other with one of said pads being disposed approximately at a midpoint of said top sheet while other pads are disposed near each one of said side edge portions of said top sheet, and with each one of said upper pads engaging said top edge portion of each one of said plurality of items; and said lower pads are spaced apart from each other with one of said pads being disposed approximately at a midpoint of said bottom sheet while other pads are disposed near each one of said side edge portions of said bottom sheet, and with each one of said lower pads engaging said bottom edge portion of each one of said plurality of items.

13. A package as defined in claim 10, wherein said pads are formed from sheets of corrugated paperboard.

14. A package as defined in claim 8, wherein said film is stretchable plastic.

15. A package as defined in claim 8, further including a slip sheet abutting against said bottom sheet of said package.

16. A package as defined in claim 15, wherein said slip sheet includes tab portions which extend outwardly beyond a margin of said bottom sheet.

17. A package as defined in claim 15, wherein said slip sheet is formed from solid fiberboard.

18. A package, comprising:

a plurality of items, disposed in a side-by-side manner within said package and in a substantially parallel relationship with respect to each other, and wherein each one of said plurality of items includes a top edge portion, a bottom edge portion, and a middle section disposed between said top and bottom edge portions and having opposed side edge portions;

a top sheet having an upper surface, a lower surface, and opposed side edge portions respectively disposed adjacent to said opposed side edge portions of said plurality of items and disposed upon opposite sides of a middle portion of said top sheet;

a bottom sheet having an upper surface, a lower surface, and opposed side edge portions, disposed upon opposite sides of a middle portion of said bottom sheet, respectively disposed adjacent to said opposed side edge portions of said plurality of items;

a plurality of upper pads spaced apart from each other, each one of said plurality of upper pads having a plurality of spaced slots defined therein, abutting against said lower surface of said top sheet, and adapted to receive and retain said top edge portions of said plurality of items within said plurality of spaced slots when said package is assembled;

a plurality of lower pads spaced apart from each other, each one of said plurality of lower pads having a plurality of spaced slots defined therein, abutting against said upper surface of said bottom sheet, and adapted to receive and retain said bottom edge portions of said plurality of items within said plurality of spaced slots when said package is assembled;

a pair of end caps respectively having a base wall, and a top flange, a bottom flange, and side flanges extending from said base wall, said base walls of said pair of end caps respectively overlying said opposed side edge portions of said plurality of items, said top and bottom flanges respectively overlying and underlying said opposed side edge portions of said top sheet and said bottom sheet when said package is assembled by being removably mounted upon said opposed side edge portions of said top and bottom sheets so as to embrace and retain said top and bottom sheets in position with respect to each other, and with respect to said opposed side edge portions of said plurality of items, and yet facilitate disassembly of said package by removal of said pair of end caps from said opposed side edge portions of said top and bottom sheets, when said plurality of items are to be removed from said package, with said opposed side edge portions of said top and bottom sheets remaining intact with said middle portions of said top and bottom sheets so as to permit reassembly of said pair of end caps onto said opposed side edge portions of said top and bottom sheets when reassembly of said package is desired, and said side flanges of said pair of end caps overlying portions of said middle sections of an end one of said plurality of items disposed within said package with portions of the middle section of at least one of said plurality of items, disposed upon one end of said package, remaining exposed to view when said package is assembled; and film wrapped around said pair of end caps and said exposed middle section portions of said at least one of said plurality of items, disposed upon said one end of said package, when said package is assembled.

19. A package as defined in claim 18, wherein said film overlaps a portion of said top and bottom sheets when the package is assembled.

20. A package as defined in claim 18, wherein:

said upper pads are spaced apart from each other with one of said pads being disposed approximately at a midpoint of said top sheet while other pads are disposed near each one of said side edge portions of said top sheet; and said lower pads are spaced apart from each other with one of said pads being disposed approximately at a midpoint of said bottom sheet while other pads are disposed near each one of said side edge portions of said bottom sheet.

* * * * *